United States Patent [19]

Bavis

[11] 4,010,824

[45] Mar. 8, 1977

[54] CONVEYOR SYSTEM FOR DRIVE-IN BANKS AND THE LIKE

[76] Inventor: Edward F. Bavis, c/o The E. F. Bavis & Associates, Inc., 200 Jimson Road, Cincinnati, Ohio 45215

[22] Filed: Dec. 24, 1975

[21] Appl. No.: 644,112

[52] U.S. Cl. ..... 186/1 C

[51] Int. Cl.[2] ..... E04H 3/04

[58] Field of Search ..... 186/1 C, 1 R; 198/165, 198/162, 190, 204, 110, 626, 627, 628, 604, 605, 606, 607, 817

[56] References Cited

UNITED STATES PATENTS

| | | | |
|---|---|---|---|
| 2,713,412 | 7/1955 | Douglass | 198/190 |
| 2,833,394 | 5/1958 | Cordis | 198/165 |
| 2,925,886 | 2/1960 | Grondona | 186/1 C |
| 3,010,160 | 11/1961 | Lytton | 198/110 |
| 3,289,818 | 12/1966 | Kittredge | 198/190 |
| 3,881,573 | 5/1975 | Cotter | 186/1 C |

*Primary Examiner*—Trygve M. Blix
*Assistant Examiner*—Reinhard J. Eisenzopf
*Attorney, Agent, or Firm*—Melville, Strasser, Foster & Hoffman

[57] ABSTRACT

An integrated conveyor system for use in drive-in banks and the like for conveying a deposit box or similar receptacle from a remote customer station to a teller station, the system comprising a pair of self-contained vertical modules, one at the customer station and the other at the teller station, interconnected by a self-contained horizontal module, the vertical modules each incorporating opposing sets of conveyor belts arranged to convey the deposit box therebetween in a vertical path of travel, the sets of belts being guided by staggered sets of idler rolls positioned to cause the sets of belts and the box conveyed therebetween to move in a sinuous path of travel in such fashion that the box is securely engaged at all times by the sets of belts, the horizontal module having translation members at its opposite ends to move the box from vertical to horizontal, or from horizontal to vertical position, together with a belt conveyor for moving the box horizontally from one end of the module to the other, of actuating switches being provided to initiate movement of the various sets of conveyor belts upon the introduction of the box into one end of the system, and to deactivate the conveyor belts when the box is discharged at the opposite end of the system, together with teller controlled over-ride switches for starting and stopping the conveyors.

20 Claims, 6 Drawing Figures

CONVEYOR SYSTEM FOR DRIVE-IN BANKS AND THE LIKE

BACKGROUND OF THE INVENTION

Drive-in facilities by means of which bank customers may transact their business without leaving their vehicles have become increasingly popular, particularly in suburban locations, to the point where two, three, or even more stations are required to accommodate the traffic; and where multiple stations are involved, it is extremely difficult to provide two or more teller stations in locations where the motorist can drive up to the teller station and transact business with the teller by means of an extensible drawer in which currency, deposit slips and the like may be transferred between the teller and the customer. To alleviate this problem, as well as conserve space and enhance traffic flow, remote customer stations have been provided in the form of islands having remote facilities for transferring items back and forth between the remote customer station and the teller station. In addition to increasing the number of customers who may transact their business at any given time, a lesser number of tellers is usually required in that one teller can service more than one customer station.

For the most part, vacuum systems are utilized to convey the items back and forth between the customer stations and the teller stations. Such vacuum systems are expensive to install and to operate, and the number and size of items which can be transported is relatively limited due to the size of the normally cylindrical containers required for travel through the vacuum lines. In addition, should one of the lines be plugged, either by one of the containers or by foreign materials inadvertently, or even deliberately, introduced into the vacuum lines, considerable difficulty is often encountered in removing the obstruction and any containers which might be trapped in the system by reason of the obstruction. Similar objections are encountered with other forms of moving conveyors, particularly those which move underground or are otherwise relatively unaccessible for maintenance and repair; and if a stoppage results due to a malfunction in only a portion of the system, the entire system may have to be shut down until the necessary parts can be obtained and the repairs made, which may put the system out of operation for a number of hours, days, or even weeks.

In contrast to the foregoing the instant invention provides an integrated conveyor system which is relatively inexpensive both insofar as initial cost is concerned as well as in its cost of operation, and which can be easily installed and service.

SUMMARY OF THE INVENTION

In accordance wth the present invention, as integrated conveyor system is provided in the form of vertical and horizontal modules or units which are relatively simple and inexpensive construction and which can be pre-fabricated and require minimum installation time and labor.

In its basic form, the system comprises a pair of vertical modules which are of essentially identical construction, longitudinally their lengths may vary, as may the operation controls, depending upon whether the module is utilized at the teller station or the customer station. Each module comprises a simple box-like frame mounting a pair of centrally disposed standards which support the sheaves about which the various sets of conveyor belts travel, together with the idler rolls which guide the sets of belts in cooperating sinuous paths with the deposit box entrapped therebetwen. Each of the modules is adapted to be seated upon a box receiving unit having a pivotally mounted scoop by means of which the box may be readily engaged by the lowermost end of the conveyor belts or, upon discharge of the box from the conveyor belts, the scoop acts to receive and position the box for handling by the customer or teller, as the case may be.

In similar fashion, the horizontal module comprises a box-like frame which mounts a guide track and a set of cooperating conveyor belts and idler rollers, together with a separate drive unit for the set of horizontal conveyor belts. At its opposite ends, the horizontal module mounts curved guide channels which act as translating means, the guide channels overlying the upper ends of the sets of conveyor belts in the vertical modules and serving to guide the box being conveyed in a arcuate path between the vertical sets of belts and the horizontal set of belts. The modules readily lend themselves to being fitted into hollow columns or beams, and by providing the columns and beams with one or more removable sides, the modules can be readily exposed for servicing and repair or, if necessary, the entire module may be readily removed and replaced. As such, the modules operate independently of each other, except to the extent that their drive motors, which are reversible, are interconnected for operation in unison through a common control circuit. Each module may be independently wired and the wiring for the several modules interconnected by detachable connectors to form the complete control circuit.

The conveying system of the present invention permits the use of a relatively large, rectangular deposit box capable of holding at one time all of the items involved in the great majority, if not all, of the banking transactions which might take place. The box will comprise a bottom with a hinged lid, preferably molded from plastic and provided with a snap-lock interengagement of the bottom and cover. While the snap-lock engagement wll normally hold the lid closed, the sets of opposing conveyor belts in the vertical modules also performs a clamping action to hold the top and bottom parts in closed position even though their snap-lock engagement may be faulty.

A significant feature of the invention is the sinuous path of travel followed by the sets of conveyor belts in the vertical modules, particularly when a deposit box is engaged therebetween, the spacing of the belt engaging idler rolls being such that the box will be moved back and forth in a sinuous path with the belts and idler rolls coacting to prevent the box from slipping or falling relative to the belts irrespective of whether it is being moved upwardly or downwardly. The speed of travel of the box is accurately controlled in both directions and the stopping of the belts relative to the discharge of the box from the lowermost end of either vertical module will be such as to retard the speed of the box and hence its impact as it is received in the underlying scoop.

DESCRIPTION OF THE PREFERRED EMBODIMENT

Figure 1:
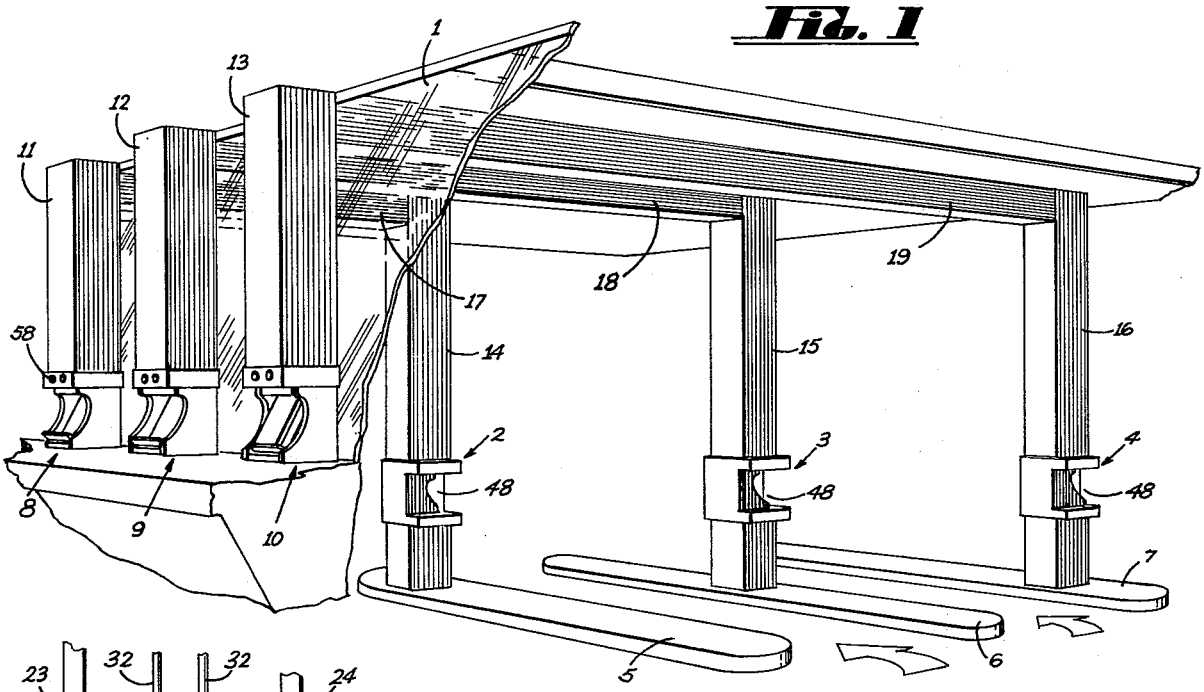
FIG. 1 is a perspective view with parts broken away illustrating a typical installation utilizing a series of three integrated conveyor systems in accordance with the present invention.

Referring first to FIG. 1, which illustrates an exemplary installation of the integrated conveyor system of the present invention, the inside of the teller's station lies to the left of the window 1 which, in most instances, will comprise a window of the bank building. The installation illustrated comprises three customer stations 2, 3, and 4 located on the space apart islands 5, 6, and 7, respectively, which define drive-through roadways therebetween. Teller stations 8, 9, and 10 are located to the left of window 1, i.e., within the bank building, there being a corresponding teller station for each of the customer stations.

Hollow vertical columns 11, 12, and 13 project upwardly from the teller stations 8, 9, and 10, each of the hollow columns containing a vertical conveyor module to be hereinafter described in detail. Similarly, the hollow vertical conveyor module to be hereinafter described in detail. Similarly, the hollow vertical colums 14, 15, and 16 each contains a vertical conveyor module. The upper ends of the sets of vertical columns are interconnected by hollow beams 17, 18, and 19; and each of the hollow beams contains a horizontal conveyor module, also to be described in detail hereinafter. The hollow columns and beams serve to cover and protect the conveyor modules; and preferably they will be formed with hinged or removable panels so that the enclosed modules may be easily exposed for servicing and repair.

The vertical modules contained in the colums 11, 12, and 13 will be of identical construction, as will be the vertical modules contained in the columns 14, 15, and 16, although the lengths of the modules may differ, the vertical modules at the teller stations usually being shorter than the vertical modules at the customer stations due to the fact that the customer stations are usually at a lower elevation to accommodate a customer seated in a passenger vehicle. The horizontal beams 17, 18, and 19 will vary in length in accordance with the distance between the customer stations and corresponding teller stations, usually differing by fixed increments in accordance with the distance between adjacent islands, which preferably will be uniform. Essentially, the horizontal conveyor modules will be of identical construction but will vary in length depending upon the distance to be spanned. If desired, however, the horizontal modules may be divided into self-contained sections for convenience in handling and installation.

Figure 2:
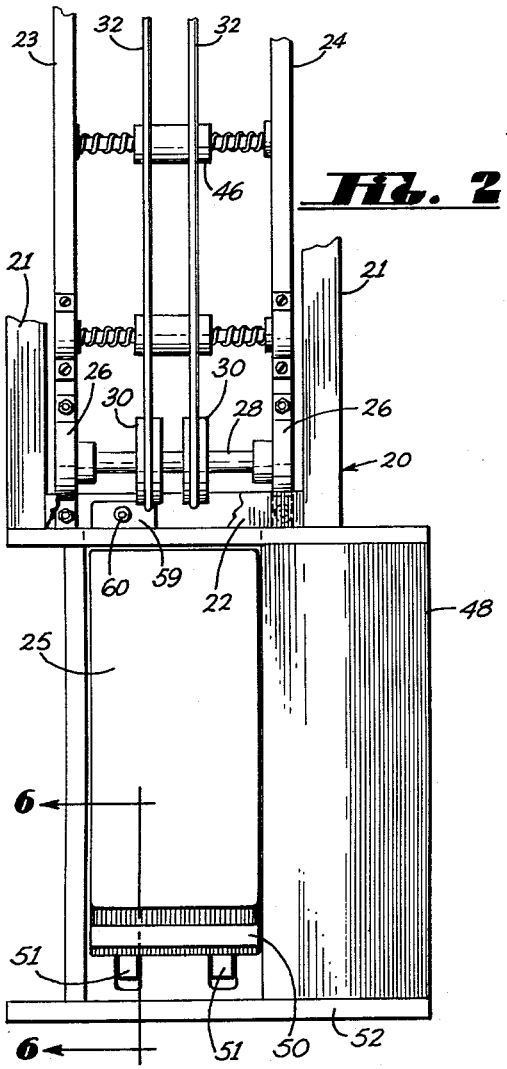
FIG. 2 is a partial side elevational view, with portions broken away, of the lowermost end of a vertical module together with the underlying box receiving scoop mechanism.
Figure 3:
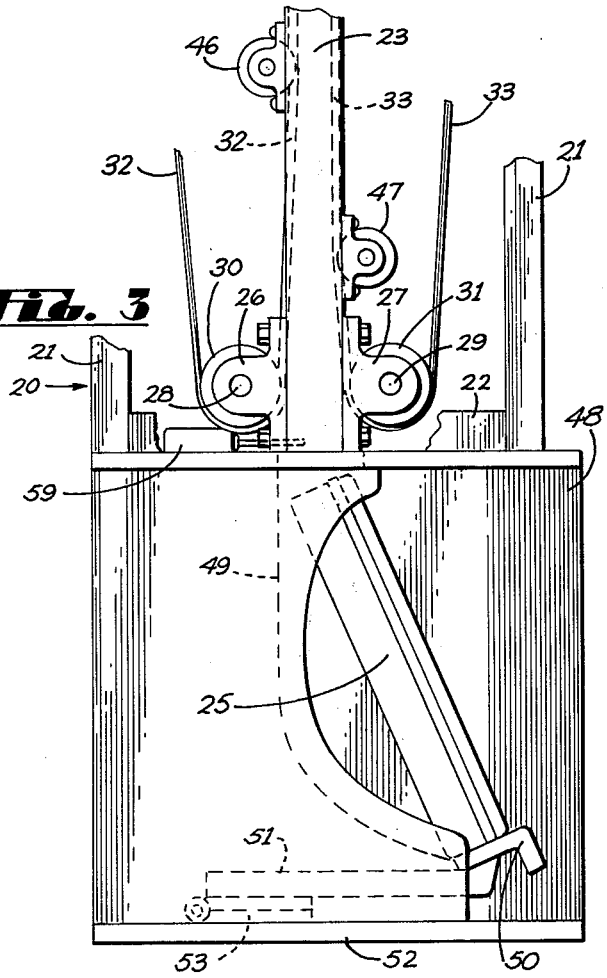
FIG. 3 is a partial side elevational view with parts broken away taken from the left-hand side of FIG. 2.

Referring next to FIGS. 2 and 3, each of the vertical modules comprising a box-like supporting frame, indicated generally at 20, having vertical corner posts 21 interconnected by horizontal brace members 22. The corner posts may be conveniently constructed of right-angle stock, as may the horizontal brace members, although the latter may also comprise flat stock, the various members being welded, bolted or otherwise secured together to form an essentially rigid box-like frame, which will be of a size to be received within the vertical columns.

An oposing pair of vertical supports 23 and 24 is mounted within the box-like frame, the vertical supports being spaced apart by a distance slightly greater than the width of the deposit box 25, as will be apparent from FIG. 2.

Figures 4, 5, 6:
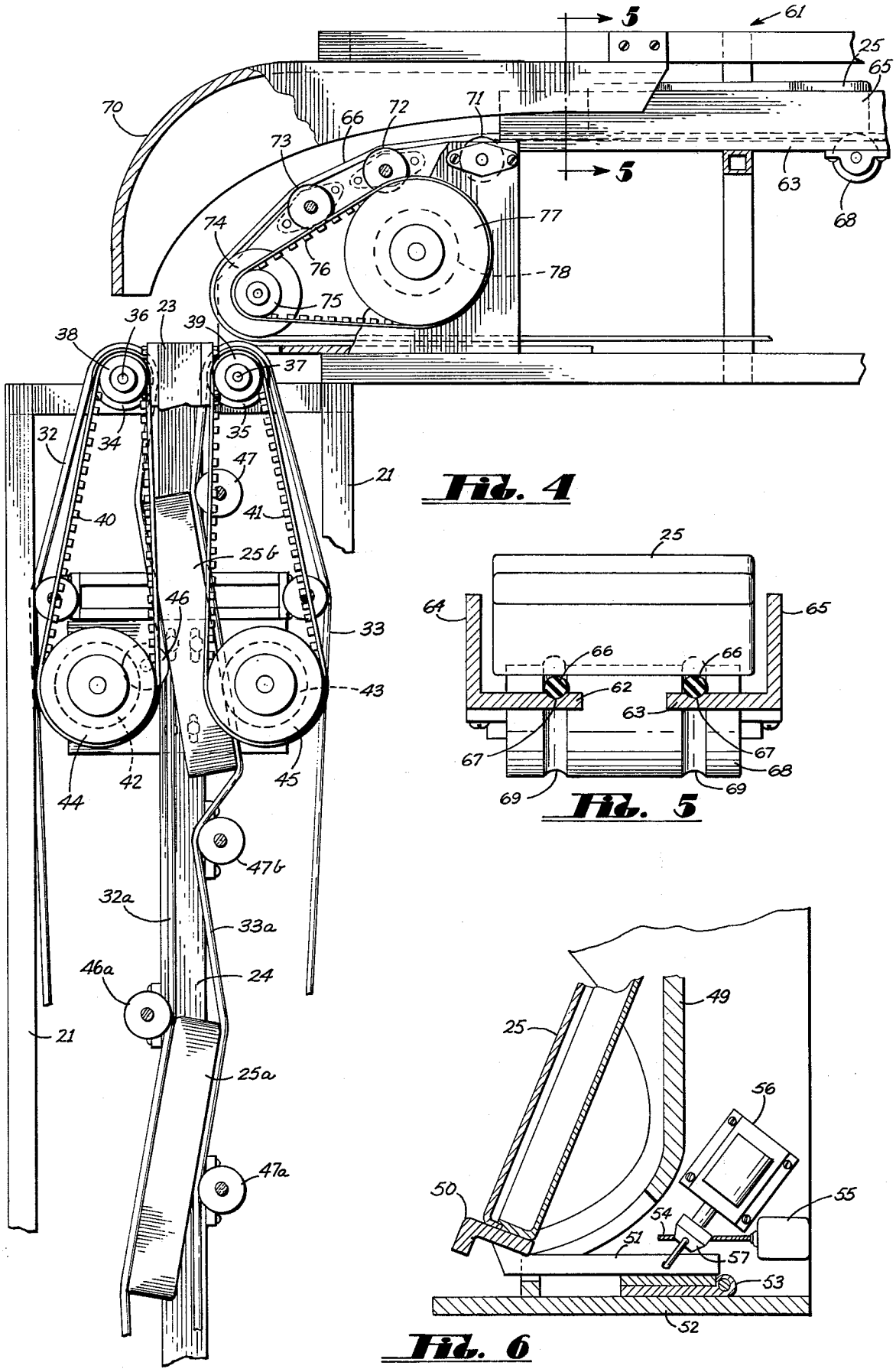
FIG. 4 is a partial side elevational view, with parts broken away, illustrating the upper end of a vertical module and an end of the adjoining horizontal module.
FIG. 5 is an enlarged vertical sectional view taken along the line 5—5 of FIG. 4 illustrating the guide track and coacting set of conveyor belts for advancing the deposit box from one end to the other of the horizontal module.
FIG. 6 is an enlarged vertical sectional view taken along the line 6—6 of FIG. 2.

At their lowermost ends the supports 23 and 24 mount oppositely directed sets of brackets 26 and 27 which rotatably journal shafts 28 and 29 mounting sets of sheaves 30 and 31, respectively. Sets of endless conveyor belts 32 and 33 pass around the sheave sets 30 and 31, the sets of conveyor belts extending upwardly to the top of the module where, as seen in FIG. 4, they pass around sets of sheaves 34 and 35 mounted on shafts 36 and 37 rotatably journaled in brackets (not shown) mounted on the upper ends of the vertical supports 23 and 24. The shafts 36 and 37 also mount gear belt pulleys 38 and 39, respectively, which are engaged by gear belts 40 and 41, respectively, which in turn are driven by electric drive motors 41 and 43 mounting gear belt pulleys 44 and 45, respectively. Thus, the drive motor 42 drives the set of conveyor belts 32, whereas the drive motor 43 drives the set of conveyor belts 33. Preferably, the drive motors 42 and 43 will comprise fractional horsepower reversible synchronous motors since such motors are relatively inexpensive to purchase and to operate, and in addition they are of relatively small size and readily lend themselves to being mounted within the confines of the box-like supporting frame.

The vertical supports 23 and 24 also mount oppositely directed sets of idler rolls 46 and 47, the idler rolls 46 lying in interdigitating relation with respect to the idler rolls 47, the sets of idler rolls being positioned to be contacted by the inner flights of the sets of conveyor belts 32 and 33, the innermost flights being indicated at 32a and 33a. The vertical distance between adjacent idler rolls 46, as well as between adjacent idler rolls 47, is somewhat greater than the length of the deposit box 25; and consequently the vertical distance between adjacent idler rolls 46 and 47, which lie in interdigitating relation, will be less than the length of the deposit box. In addition, the lateral spacing between the innermost surfaces of the rolls 46 and 47, will be less than the depth (top to bottom dimension) of the deposit box, which relationship of the idler belts causes the deposit box to travel in a sinuous path as it is moved vertically between the opposing innermost flights of the sets of conveyor belts 32 and 33. Thus, as illustrated in FIG. 4, as the leading end of the deposit box 25*a* comes into contact with the idler roll 46*a*, it is deflected to the right, effectively pivoting about the underlying opposing idler roll 47*a*. In order to permit the desired deflection of the deposit box, the sets of conveyor belts 32 and 33 will be formed from a material, such as polyurethane, which provides sufficient elasticity to permit the belts to stretch to accommodate the deflection of the deposit box. If the deposit box is traveling upwardly, its trailing end will pass beyond the idler roll 47*a* prior to the time its leading end contacts the idler roll 47*b* which deflects the deposit box in the opposite direction, the box effectively pivoting about idler roll 46*a*.

As will be evident by comparing the position of the deposit box 25*a* with that of deposit box 25*b*, also illustrated in FIG. 4, the interdigitating sets of idler rolls 46 and 47 cause the deposit box to travel in a sinuous path rather than in a straight line path; and it should be evident that in addition to being securely clamped between the innermost flights of the opposing sets of conveyor belts, the offset and interdigitating relation between the sets of idler rolls insure that the deposit box cannot slip or fall vertically. For example, slippage of the box 25*b* from the position illustrated in FIG. 4 is effectively prevented by idler roll 47*b* and the deflected inner flights of conveyor belts 33. Thus, irrespective of whether the deposit box is moving upwardly or downwardly, it is effectively constrained as it is deflected back and forth and hence caused to move in a sinuous path. Consequently, the deposit box is at all times under positive control and cannot slip or fall freely while moving in a vertical direction.

Positive control of the vertical movement of the deposit box is particularly important in discharging the box from the conveyor into the underlying box receiving unit, whether it be at the customer station or at the teller station. Referring to FIGS. 2 and 3, a box receiving unit 48 underlies the lowermost end of the vertical module. This unit has a curved wall 49 coacting with a scoop 50 which forms a seat for the lowermost end of the deposit box 25. The scoop 50 has a rearwardly projecting pair of arms which are pivotally connected to the undersurface 52 of the box receiving unit 48 by means of hinge member 53. When it is desired to insert the deposit box for delivery through the conveyor system, it is seated on the scoop in the manner illustrated in FIGS. 3 and 6, whereupon the customer or the teller, as the case may be, lifts upwardly on the scoop 50, which pivots about hinge 53, thereby causing the deposit box to ride upwardly along the curved wall 49 and enter the lowermost end of the vertical conveyor between the opposing inner flights of belts 32 and 33. As the scoop is pivoted upwardly, the flexible arm 54 of actuating switch 55 (FIG. 6) is contacted, as by means of one of the arms 51 of the scoop, thereby closing the actuating switch and energizing the drive motors for the conveyors. Thus, as the deposit box is lifted and inserted between the opposing sets of conveyor belts, the drive motors for the conveyor belts are actuated and the conveyor belts will be driven in the direction to transport the deposit box to the opposite station. In this connection, it will be understood that the actuating switch 55 at the teller station will actuate the drive motors in one direction, whereas the actuating switch at the customer station will actuate the drive motors in the opposite direction.

In the event the customer has difficulty in operating the scoop or fails to understand its operaton, a teller actuated solenoid 56 may be provided at the customer station, the solenoid having an arm 57 connected to the arms 51 of the scoop. Actuation of the solenoid will lift the scoop and hence cause the deposit box to be inserted in the conveyor. Alternatively, the teller may utilize the solenoid to recall a deposit box which has just been delivered to the customer station. A control switch 58 (FIG. 1) will be provided at the teller station to actuate the solenoid.

Discharge of the deposit box from the conveyor system into either of the box receiving units 48 is also automatically controlled. As seen in FIGS. 2 and 3, a switch 59 having a flexible arm 60 is mounted to be contacted by the deposit box 25 as it approaches the box receiving unit 48. As the box 25 travels downwardly for discharge, it will contact the arm 60 of switch 59 which will deenergize the drive motors and hence stop the movement of the conveyor belts. By vertical adjustment of the position of switch 59, the slow-down and stopping of the conveyor belts can be timed so that the speed of the descending box will be retarded and it will be released by the conveyor just prior to the conveyor belts coming to a complete stop, thereby permitting the deposit box to slip gently into contact with the underlying scoop, the box again assuming the position illustrated in FIGS. 2 and 6, in which position the box may be readily gripped and removed from the box receiving unit. Alternatively, a time delay relay can be included in the circuit.

Details of the horizontal module are illustrated in FIGS. 4 and 5, the module having a box-like supporting frame 61 which mounts an elongated guide track which, in the embodiment illustrated, comprises a pair of guide plates 62 and 63 (FIG. 5) having upstanding side rails 64 and 65, respectively, the side rails 64 and 65 being spaced apart by a distance sufficient to permit the deposit box 25 to be conveyed therebetween. A set of conveyor belts 66 travels along the upper surfaces of the guide plates 62 ad 63; and if desired, the guide plates 62 and 63 may be provided with longitudinal grooves 67 to assist in guiding the conveyor belts in the desired paths of travel. In addition, it is preferred to support the conveyor belts 66 at spaced apart intervals on idler rolls 68 which may be grooved, as at 69, to receive the conveyor belts. It is also preferred that the uppermost surfaces of the idler rolls 68 extend above the uppermost surfaces of guide plates 62 and 63, in the manner illustrated in FIG. 5, such arrangement serving to reduce the frictional drag on the conveyor belts as they travel along the guide plates 62 and 63.

The transfer of the deposit box between the vertical and horizontal modules is effected by means of curved translation members 70, one of which is illustrated in FIG. 4. The translation member 70 overlies the uppermost end of the vertical module and is positioned to guide the deposit box through an arc of 90°, such guiding movement being implemented by the conveyor belts 66 which also travel in an essentially curved path, being guided by guide rolls 71, 72 and 73, together with sheaves 74 about which the conveyor belts pass to define a return flight extending along the lower portion of the box-like support 61. The conveyor belts 66 are driven through sheaves 74 by means of gear belt pulley 75, gear belt 76, and gear belt pulley 77 operatively connected to fractional horse power reversible drive motor 78. A similar guide roll and sheave arrangement is provided at the opposite end of the box-like frame 61 but omitting the drive motor and drive means. Preferably the guide rolls 71, 72 and 73 will be identical to the idler rolls 68, including the provision of conveyor belt receiving grooves.

It should be evident from the construction just described that if the deposit box is being moved upwardly through one of the vertical modules, it will contact and be deflected in the direction of the conveyor belts 66 prior to its passage beyond the uppermost ends of the sets of vertical conveyor belts 32 and 33 and hence will be engaged and advanced by the conveyor belts 66 which, acting in conjunction with the curved translation member 70, turn the box to a horizontal position for travel along the guide plates 62 and 63. When the deposit box reaches the end of the horizontal module, the belts 66 and curve translation member 70 will again coact to direct the leading end of the box downwardly for engagement by the sets of belts in the underlying vertical module.

As should not be evident, the instant invention provides an integrated conveyor system composed of self-contained vertical and horizontal modules by means of which a deposit box or like container may be transported from one end of the system to the other, and returned, depending upon the direction in which the sets of conveyor belts are driven. The modules are of relatively simple and inexpensive construction and may be easily repaired or, should the necessity arise, the entire module may be readily removed and replaced as a unit, the only required connection being control circuits for the drive motors.

It will be understood that modifications may be made in the invention without departing from its spirit and purpose. A number of such modifications have already been set forth and others will undoubtedly occur to the skilled worker in the art upon reading specification. For example, the size and length of the modules does not constitute a limitation on the invention; and depending upon the distance to be traversed, the horizontal module may comprise two or more modular units. If two units are employed, it will be evident that each unit will have a translation means at only one end, the abutting ends simply having sheaves about which the sets of conveyor belts pass in close proximity to each other so that the box will readily pass from one set of belts to the other. Similarly, the curve translation members can be mounted on the uppermost ends of the vertical modules rather than on the ends of the horizontal module. Instead of a hinged scoop beneath the vertical modules to lift the deposit box, it may be lifted by a slide mechanism. Accordingly, it is not intended that the invention be limited other than in the manner set forth in the claims which follow.

The embodiments of the invention in which an exclusive property or privilege is claimed are defined as follows:

1. In an integrated conveyor system for conveying a container between a spaced apart pair of stations, a first container receiving means at one of said stations, a first vertical module extending upwardly from said first container receiving means, a second container receiving means at the other of said stations, a second vertical module extending upwardly from said second container receiving means, and a horizontal module extending between the upper ends of said first and second vertical modules, reversible containers conveying means contained in each of said modules, means for concurrently driving each of said container conveying means in the same direction, and translation means at the opposite ends of said horizontal module for transferring the container between the vertical and horizontal modules.

2. The conveyor system claimed in claim 1 wherein the reversible conveyor means contained in each of said vertical modules comprises spaced apart sets of conveyor belts defining a container conveying path of travel therebetween, and means for deflecting a container back and forth as it is being conveyed between said sets of belts whereby said container is conveyed in a sinuous path of travel.

3. The conveyor system claimed in claim 2 wherein the means for deflecting the container back and forth comprise opposing sets of belt contacting idler rolls arranged in interdigitating relation relative to each other.

4. The conveyor system claimed in claim 3 wherein the vertical distance between adjacent interdigitating rolls is less than the distance between the leading and trailing ends of the container being conveyed.

5. The conveyor system claimed in claim 1 wherein said horizontal module includes guide means defining a path or travel for the container, and wherein the reversible conveyor means contained in said horizontal module comprises a set of conveyor belts coacting with said guide means.

6. The conveyor system claimed in claim 5 wherein said guide means comprises horizontally diposed guide plates having logitudinally extending grooves in which said conveyor belts are received.

7. The conveyor system claimed in claim 6 including grooved idler rolls positioned to engage said conveyor belts at spaced apart intervals.

8. The conveyor system claimed in claim 7 wherein said idler rolls are positioned to lift the conveyor belts from the grooves in said guide plates.

9. The conveyor system claimed in claim 1 wherein said translation means comprises a curved plate at each end of the horizontal module positioned to contact and guide the container in an arcuate path as it travels between the horizontal and vertical modules.

10. The conveyor system claimed in claim 9 wherein the reversible conveyor means contained in the horizontal module comprises a set of conveyor belts, sets of guide rolls for the opposite ends of said conveyor belts, said sets of guide rolls being positioned to cause said conveyor belts to engage and advance the container when it is in contact with said curved plates.

11. The conveyor system claimed in claim 1 wherein said container receiving means each comprises a pivotally mounted container receiving scoop, said scoop being movable from a lowermost container receiving position to an uppermost position in which the upper end of the container is positioned to be engaged by the container conveying menas in the overlying vertical module.

12. The conveyor system claimed in claim 11 wherein the means for drivig the container conveying means comprises reversible motor means, and start switch means for energizing said reversible motor means, said start switch means being positioned to be actuated by said container receiving scoops as they are moved toward their uppermost positions.

13. The conveyor system claimed in claim 12 including stop switch means for deenergizing said reversible motor means, said stop switch means being mounted at the lowermost ends of said vertical modules in positions to be contacted by a downwardly traveling container.

14. The conveyor system claimed in claim 13 including scoop moving means operatively connected to the scoop at one of the stations, and actuating means for said scoop moving means at the other of said stations.

15. In an integrated conveyor system, for conveying a container between a spaced apart pair of stations, a first container receiving means at one of the stations, a first vertical module extending upwardly from said first conveyor receiving means, a second container receiving means at the other of said stations, a second vertical module extending upwardly from said second container receiving means, and a horizontal module extending between the upper ends of said first and second vertical modules; each of said modules comprising a box-like supporting frame; spaced apart sets of conveyor belts mounted within the box-like supporting frames of said vertical modules, opposing sets of belt engaging idler rolls arranged in interdigitating relation relative to each other and positioned to deflect the container back and forth as it is conveyed by said sets of belts to define a sinuous path of travel therebetween; horizontally extending container guide means mounted within the box-like supporting frame of said horizontal module, a set of conveyor belts associated with said guide means; reversible drive motor means for each of said sets of conveyor means; means associated with said first and second container receiving means for energizing said drive motor means, and means associated with the lowermost ends of said vertical modules for deenergizing said motor drive means, the motor energizing means associated with said first container receiving means acting to energize said reversible motor drive means to drive said sets of conveyor belts in a direction to convey the container from the first container receiving means to the second container receiving means, and the drive motor energizing means associated with said second container receiving means acting to energize said motor drive means to drive said sets of conveyor belts in a direction to return the container to the first container receiving means; and curved translation members mounted on the opposite ends of the box-like supporting frame of the horizontal module for transferring the container between the sets of conveyor belts mounted in the horizontal and vertical modules.

16. In an integrated conveyor system for conveying a container between a spaced apart pair of stations, a vertical module comprising a box-like supporting frame, spaced apart sets of conveyor belts mounted within the box-like supporting frame, reversible drive means for said sets of conveyor belts also mounted within said box-like supporting frame, and means for causing a container belt conveyed between said sets of belts to be alternately deflected in opposite directions in a sinuous path of travel.

17. The module claimed in claim 16 wherein the means for causing the container to be deflected as it is being conveyed said sets of conveyor belts comprise opposing sets of idler rolls mounted within the box-like supporting frame and arranged in interdigitating relation relative to each other.

18. The module claimed in claim 17 wherein the vertical distance between adjacent interdigitating rolls is less than the distance between the leading and trailing ends of the container being conveyed.

19. For use in an integrated conveyor system, a horizontal conveyor module comprising a box-like supporting frame, longitudinally extended container guide means mounted within said box-like supporting frame, said guide means comprising horizontally disposed guide plates having longitudinally extending grooves therein, a set of conveyor belts slidably received in the longitudinally extending grooves in said guide plates, grooved idler rolls positioned to engage said conveyor belts at spaced apart intervals, said idler rolls being positioned to lift said belts out of contact with underlying portions of said guide plates, and reversible drive means for said conveyor belts also mounted within said box-like supporting frame.

20. The module claimed in claim 19 including curved translation plates mounted on the opposite ends of said box-like supporting frame, and sets of guide rolls positioned to guide the opposite ends of said set of conveyor belts in curved paths of travel adjacent said curved translation plates.

* * * * *